US012600530B2

(12) United States Patent
Moretti

(10) Patent No.: US 12,600,530 B2
(45) Date of Patent: Apr. 14, 2026

(54) CAP

(71) Applicant: LUMSON S.p.A., Capergnanica (IT)

(72) Inventor: Matteo Moretti, Crema (IT)

(73) Assignee: LUMSON S.p.A., Capergnanica (IT)

( * ) Notice: Subject to any disclaimer, the term of this patent is extended or adjusted under 35 U.S.C. 154(b) by 41 days.

(21) Appl. No.: 18/748,564

(22) Filed: Jun. 20, 2024

(65) Prior Publication Data

US 2024/0425239 A1 Dec. 26, 2024

(30) Foreign Application Priority Data

Jun. 22, 2023 (IT) ..... 102023000012885

(51) Int. Cl.
*B65D 41/04* (2006.01)
*B65D 51/16* (2006.01)

(52) U.S. Cl.
CPC ..... *B65D 41/0492* (2013.01); *B65D 41/045* (2013.01); *B65D 51/1688* (2013.01)

(58) Field of Classification Search
CPC ..... A47G 2019/125; A47J 27/0815; B65D 1/0246; B65D 2543/00037; B65D 39/02; B65D 41/62; B65D 41/0492; B65D 41/045; B65D 51/1688; B65D 41/0442; B65D 53/02; B65D 81/18
See application file for complete search history.

(56) References Cited

U.S. PATENT DOCUMENTS 1,971,307 A 8/1934 Carvalho
3,650,426 A * 3/1972 Miller ..... B65D 50/041 215/220
3,722,727 A * 3/1973 Gach ..... B65D 50/041 215/220
3,822,805 A * 7/1974 Marchant ..... B65D 50/041 215/219
3,830,390 A * 8/1974 Gach ..... B65D 50/041 215/220
3,857,505 A * 12/1974 Mumford ..... B65D 50/041 215/220
3,915,326 A * 10/1975 Hrubesky ..... B65D 50/041 215/219
4,385,705 A * 5/1983 Kusz ..... B65D 50/041 215/220
4,673,095 A * 6/1987 Puresevic ..... B65D 50/041 215/220
4,747,500 A * 5/1988 Gach ..... B65D 55/02 215/349
5,184,739 A * 2/1993 Kusz ..... B65D 50/041 215/230

(Continued)

FOREIGN PATENT DOCUMENTS

FR 2757834 A1 7/1998
KR 101268157 B1 5/2013

(Continued)

*Primary Examiner* — Kareen K Thomas
(74) *Attorney, Agent, or Firm* — Dickinson Wright PLLC; Andrew D. Dorisio

(57) ABSTRACT

A cap (1) comprising a base body (2, 2') is endowed, on one of the internal sides thereof, with a thread (3), a seat (4) in which a seal (5) is housed at least partially, and a liner (6) fitted onto the base body (2) and torsionally fastened thereto, which completely conceals the base body (2) from lateral views and in at least one plan view.

10 Claims, 5 Drawing Sheets

(56) References Cited

U.S. PATENT DOCUMENTS

| | | | | | |
|---|---|---|---|---|---|
| 5,188,251 | A * | 2/1993 | Kusz | A61J 7/04 | 215/230 |
| 5,314,084 | A * | 5/1994 | Folta | B65D 51/241 | 215/350 |
| 5,695,083 | A * | 12/1997 | Obadia | B65D 41/0492 | 215/320 |
| 6,929,137 | B1 * | 8/2005 | Granger | B65D 41/3428 | 215/901 |
| 7,611,026 | B1 * | 11/2009 | Bloom | B65D 41/045 | 215/276 |
| 9,682,805 | B2 * | 6/2017 | Minnette | B65D 41/0442 | |
| 11,116,693 | B2 * | 9/2021 | Gift | B65D 50/041 | |
| 2005/0150857 | A1 * | 7/2005 | Brozell | B65D 50/041 | 215/220 |
| 2006/0278642 | A1 * | 12/2006 | Pugne | B65D 41/045 | 215/350 |
| 2010/0140268 | A1 * | 6/2010 | Lohrman | B65D 47/103 | 220/270 |
| 2011/0278254 | A1 * | 11/2011 | Petrosino | B65D 41/045 | 29/505 |
| 2015/0191279 | A1 * | 7/2015 | Price | B65D 41/3428 | 215/350 |

FOREIGN PATENT DOCUMENTS

| | | | |
|---|---|---|---|
| KR | 20180105312 | A | 9/2018 |
| KR | 102094635 | B1 | 3/2020 |

* cited by examiner

CAP

This application claims priority to Italian Patent Application for Invention No. 102023000012885 filed on Jun. 22, 2023, the disclosures of which are hereby incorporated by reference.

FIELD OF THE INVENTION

The present invention relates to a cap. In particular, the invention refers to a three-piece, single-material cap.

STATE OF THE ART

The caps that are normally fitted on bottles or jars for cosmetic or medical use, for example those containing creams, make-up products, etc., have the well-known function of hermetically sealing the container with which they are coupled and may be used to re-seal the said container further times.

In the contexts in which these containers are marketed and used, the quality of the finish thereof is of maximum importance and it is not acceptable for a container to have visible defects, which would alter the aesthetic thereof.

However, the need for quality and aesthetic perfection must be combined with matters such as production costs and—especially recently—attention to the environment, especially in terms of recyclability.

Caps with the highest aesthetic quality currently available on the market are those made with very premium (therefore expensive) materials that are either not completely recyclable or hard to recycle, such as ABS, PET, PETG, SAN, and PS.

SUMMARY OF THE INVENTION

The object of the present invention is to provide a cap which is improved with respect to the prior art.

A further object of the invention is to provide a cap that is aesthetically flawless despite being made with environmentally friendly materials.

A further but not final object of the invention is to provide a cap which is less expensive than those currently marketed but has comparable characteristics.

This and other objects are achieved by means of a cap produced according to the technical teachings of the claims annexed hereto.

BRIEF DESCRIPTION OF THE FIGURES

Further characteristics and advantages of the invention will become clearer in the description of a preferred but not exclusive embodiment of the cap, illustrated—by way of a non-limiting example—in the drawings annexed hereto, in which.

DETAILED DESCRIPTION OF THE INVENTION

With reference to the figures stated, reference number 1 is used to denote, as a whole, a cap.

Figure 2:
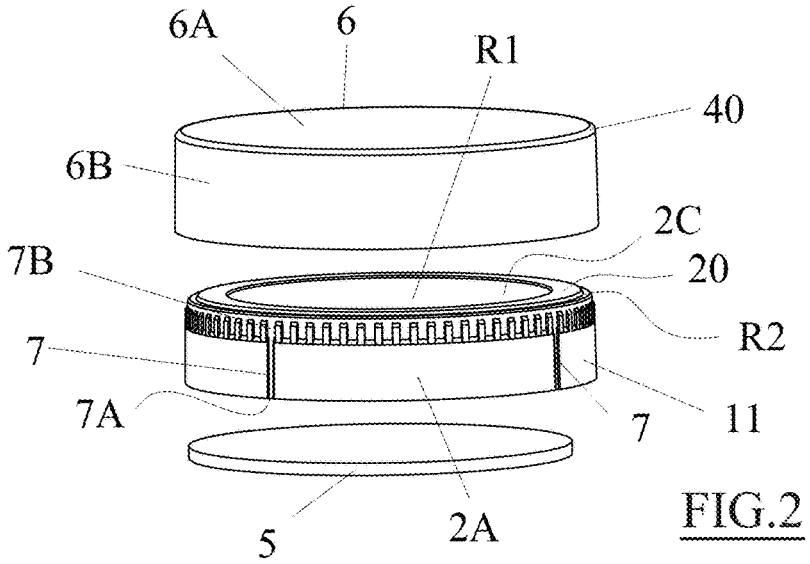
FIG. 2 is an exploded perspective view of the cap in FIG. 1.
Figure 3:
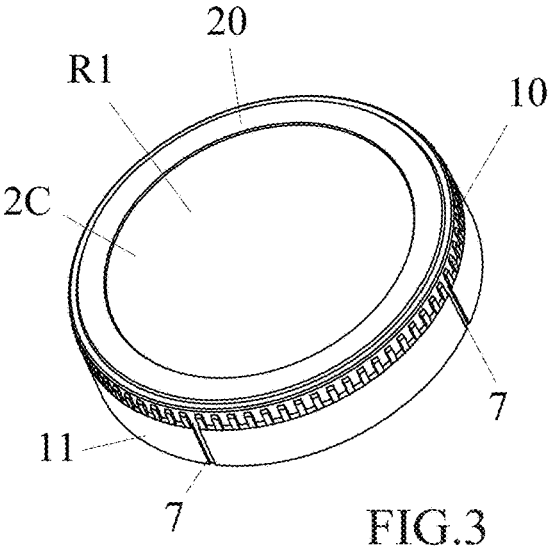
FIG. 3 is a perspective view of a part of the cap in FIG. 1.

As clearly visible in FIG. 2, the cap 1 according to the present invention comprises a base body 2 endowed, on one of the inner sides thereof, with a thread 3, a seat 4 (in practice, made in the base body 2) in which a seal 5 is housed or positioned, and a liner 6 fitted onto the base body 2 and torsionally fixed thereto.

The liner 6 completely conceals the base body 2 in the side views and at least in a (top-down) plan view.

According to one aspect of the invention, the cap 1 is made as three mutually assembled pieces made of a plastic material which is the same for all three.

For this reason, this cap can be defined as "single-material".

Preferably the plastic material is polypropylene-based material, and preferably is actually polypropylene.

Alternatively, the plastic material can be a polyethylene-based material, or preferably is actually polyethylene.

The technique employed to make of each of the three pieces is preferably injection moulding.

One aspect of the present invention is the concept of creating a threaded base body 2 (with a shape which is rather complicated in terms of the moulding process as featuring significant differences in thickness) and covering this base body 2 with a liner 6 (made of the same material) with a more linear shape (therefore featuring minimal or no differences in the thickness and therefore being simpler to mould in order to obtain a better finish).

In practice, the liner 6 may be made with an essentially homogeneous profile and thickness, which guarantees (the part visible during use) an essentially perfect external finish, i.e. devoid of sink marks or other flaws relating to the moulding technique.

Preferably the liner 6 features a side wall 6B and a ceiling 6A of essentially identical thickness.

Advantageously, this essentially identical thickness may be between 0.5 mm and 2 mm.

Furthermore, the side wall 6B may feature an essentially uniform thickness. The maximum thickness and the minimum thickness of the side wall 6B may vary by a ratio of up to 2 at the most, but preferably no more than 1.5.

The ceiling 6A may also feature an essentially uniform thickness. The maximum thickness and the minimum thickness of the ceiling 6A may vary by a ratio of up to 2 at the most, but preferably no more than 1.5.

Furthermore, the ceiling 6A and the side wall 6B may feature areas in which the thickness differs, provided that the ratio between the largest and smallest thickness is between 1 and 2, preferably between 1 and 1.5.

The only (possible) place where there may be a variation in the liner thickness is at the connection zone 40 between the ceiling and the side wall thereof.

However, the finish of this zone can be controlled by maintaining, here too, a thickness which is essentially identical or similar to the side wall 6B and the ceiling 6A, in proximity to the said area, by making appropriate connections.

Zone 40 is the zone in which the connections between walls 6A and 6B are homogeneous.

Preferably the base 2, the liner 6 (and also the seal 5) are made of the same material.

However, it is possible that the base 2, the liner (and optionally the seal 5) may be made of different materials. In this case all these materials can fall under the same recycling code, for example, code 2 or code 5 according to standard ASTM D7611.

Indeed, as is known, injection moulding PP or PE (or PP- or PE-based materials) is particularly difficult precisely because of the considerable shrinkage which occurs in the cooling stage prior to demoulding, which generates sink marks, especially in areas where the thickness of the material differs.

Provision of a liner 6 fitted onto the base body 2 (the part with the greatest differences in thickness and the 'functional' part of the cap) eliminates or minimises any aesthetic flaws in the cap 1, which can therefore also be marketed in a high-end context, where attention to detail is fanatical.

Figure 4:
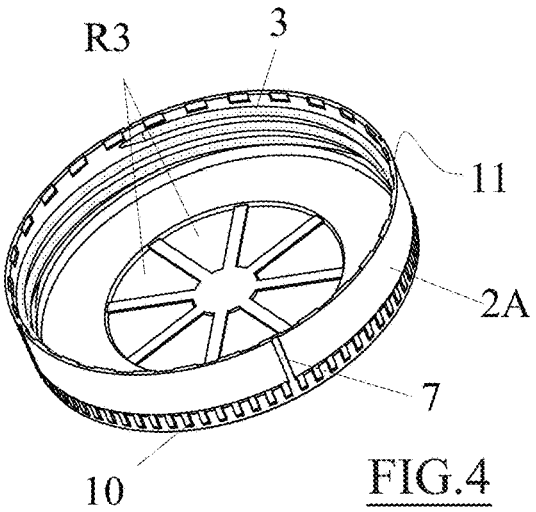
FIG. 4 shows the part shown in FIG. 3 from a further perspective.
Figure 5:
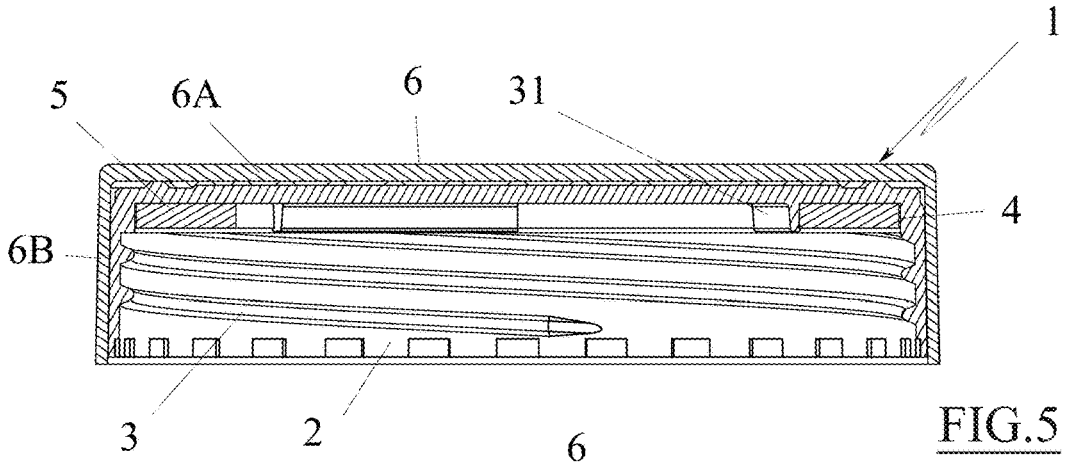
FIG. 5 is a diametrical sectional view of a different embodiment of the cap in FIG. 1.

Advantageously, the base body 2 is cup-shaped, as also visible in FIG. 4. The said base body features a ceiling 2C from which a skirt 11 extends, determining a lateral surface 2A of the base body 2.

The thread 3 is made on the skirt 11 in such a way that there are ridges protruding towards a concave part of the base body 2.

For example, the base body 2, the liner 6, and the seal are reciprocally fastened with adhesive.

The adhesive may be hot melt adhesive, vinyl adhesive, cyanoacrylate adhesive, or epoxy adhesive.

For this purpose, small cavities C1, C2, C3 may be created between the liner 6 and the base body 2, which can house the said adhesive or facilitate the spreading thereof.

More specifically, a first cavity C1 may be determined by a sunken area R1 envisaged externally, on the ceiling 2C of the base body, delimited by an edge or annular support 20 (which may be, for example, annular) with which the liner 6 is in direct contact when the liner 6 and the base body 2 are assembled. The support 20 also acts as a stroke limit for assembly.

Given the described configuration, the annular support 20 is protruding from the base body 2. As it may be seen from the figures, the annular support 20 may have a surface that is flat on its top, in the area in contact with the liner 6.

A second cavity C2 may be determined by a sunken section R2 (for example around the perimeter) envisaged at an external edge of the base body 2 and by an inner edge of the liner 6.

The third cavity C3, i.e. the one that houses the adhesive present between the liner 6 and the base body 2, may be determined by sunken sections R3 (FIG. 4) made on the inner surface of the base body 2, on the ceiling thereof. Advantageously, the said sunken sections C3 may be shaped like a segment (sector of a circle).

The base body 2 may also feature, on at least part of the said lateral surface 2A, a toothed crown 10 which promotes torsional coupling with the liner 6, coupling with a smooth surface of the liner 6.

The spaces that are determined between the troughs of the toothed crown and the liner can also constitute an outlet or a seat for the said adhesive, in order, among other things, to increase the mutual bonding surface.

The height of the toothed crown 10 can extend to approximately a quarter of the height of the skirt 11, but obviously, as in the other embodiments described below, the height may be greater; the height of the toothed crown 10 may also reach up to 9/10 of the height of the skirt or even the entire height of the skirt 11.

The lateral surface 2C of the base body 2 not reached by the crown can form a very efficient surface for centring the base body 2 and the liner 6. This is because the said surface is essentially smooth.

According to one aspect of the invention, the base body 2 may feature, on one of the outer lateral surfaces 2A thereof, at least one groove 7 which acts as an outlet for the air trapped between the base body 2 and the liner 6 during the mutual coupling thereof. In this way, it is possible to effectively prevent the pumping effect that occurs during the coupling of the base body 2 to the liner.

The groove 7 (there are preferably three grooves, more preferably four) may feature a first end that opens onto a free edge 2B of the base body 2 and a second end 7B that opens onto an interconnection edge between the said lateral surface 2A and the ceiling 2C of the said base body 2.

For example, the second end of the groove may open at the said toothed part 10 of the base body 2, if envisaged.

Advantageously therefore, the groove 7 extends up the entire height of the skirt 11.

Reference will now be made to the configuration shown in FIGS. 5-8.

In these figures, as in the others that will be detailed, the same reference numbers used earlier are used to denote parts that are functionally similar to those already illustrated. They will not, therefore, be described again.

As can be seen, in this configuration, the base 2 and the liner 6 may be mutually coupled by welding (for example ultrasonic or laser).

Figure 6:
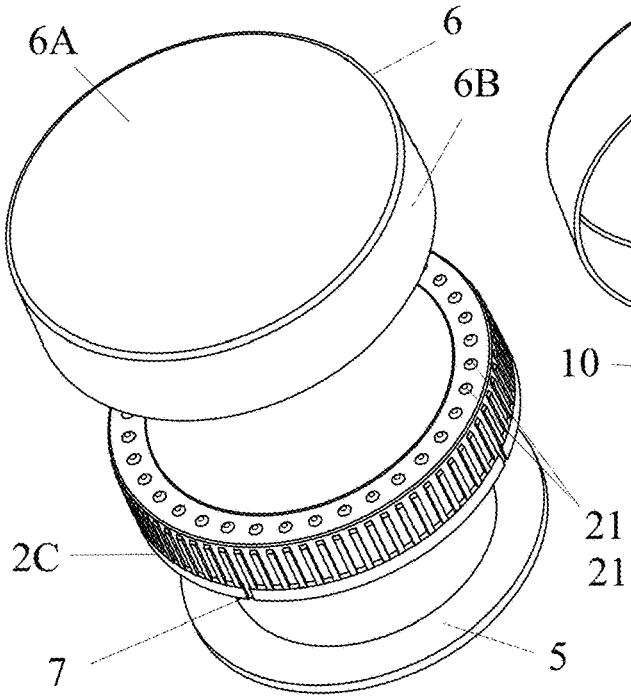
FIGS. 6 and 7 are exploded perspective views, taken from different angles, of the cap in FIG. 5.
Figure 7:
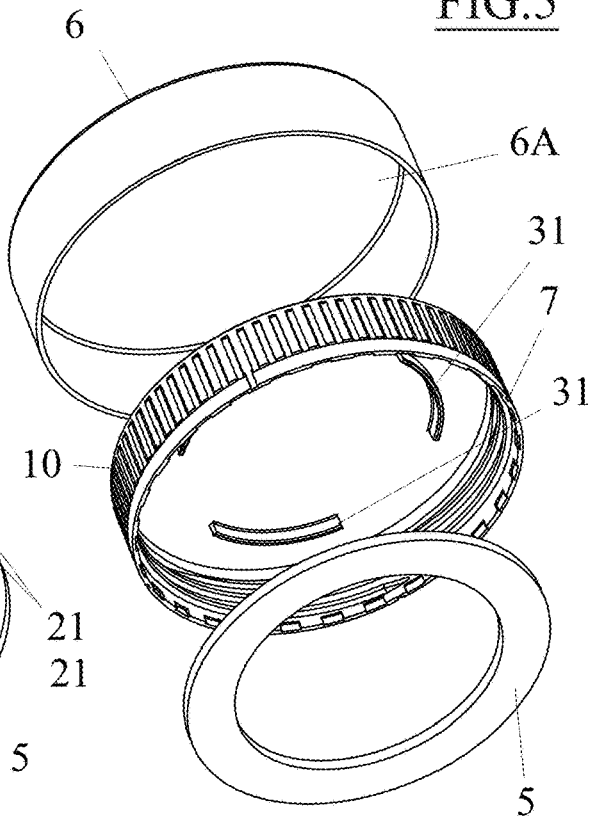
Figure 8:
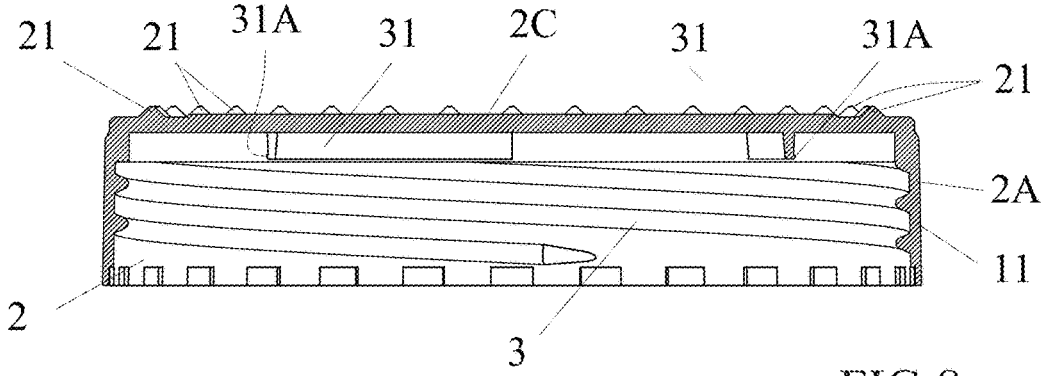
FIG. 8 is a diametrical section of part of the cap in FIG. 5.
Figure 9:
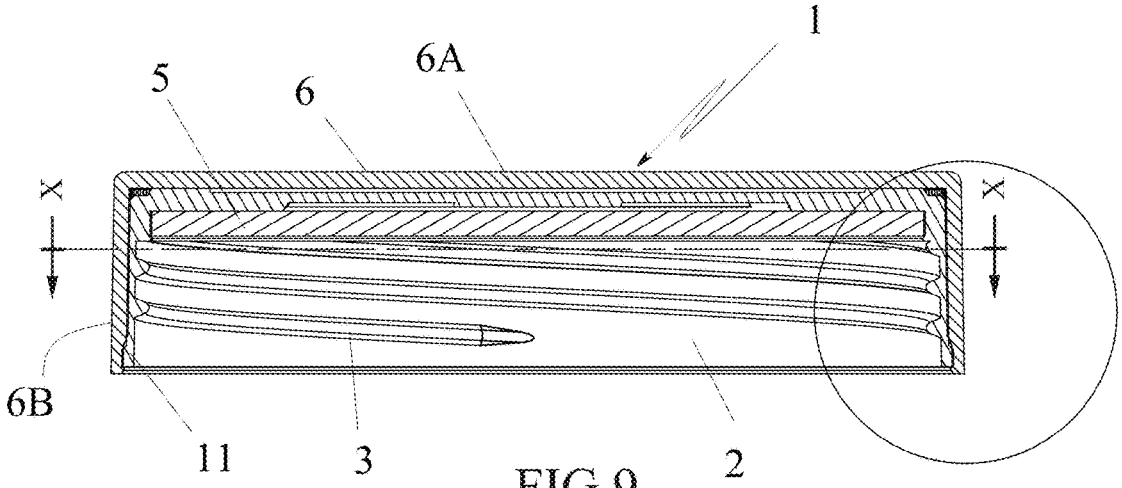
FIG. 9 is a diametrical section of a still further embodiment of the cap in FIG. 1.
Figure 10:
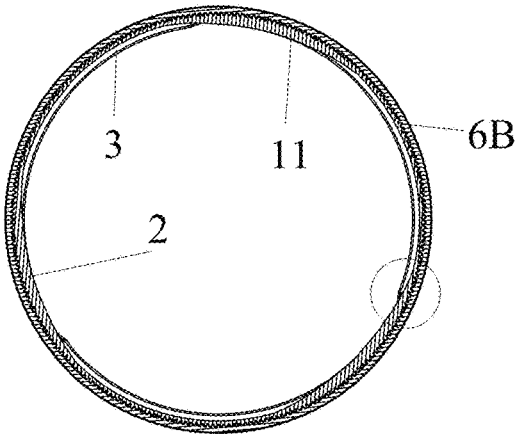
FIG. 10 is a sectional view taken along line X-X in FIG. 9.
Figure 11:
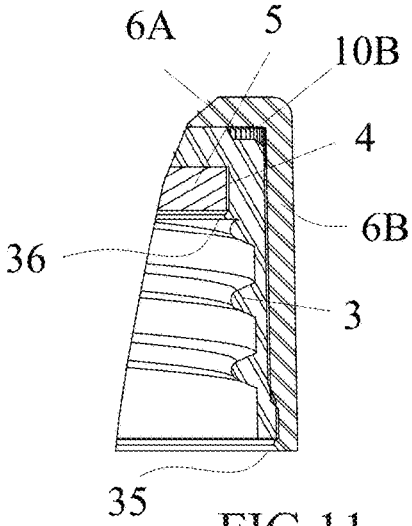
FIG. 11 is an enlargement of the part circled in FIG. 9.
Figure 12:
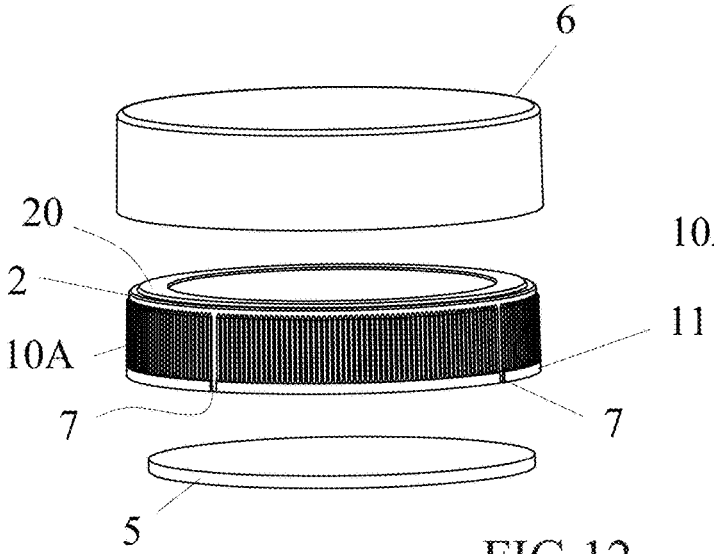
FIG. 12 is an exploded perspective view of the cap in FIG. 9.
Figure 13:
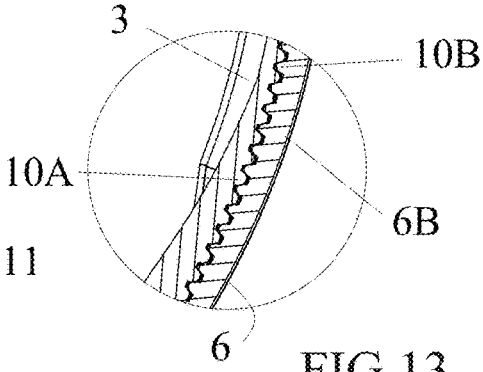
FIG. 13 is an enlarged view of the part shown in the circle in FIG. 10.

For example, on an external surface of the base body 2 ceiling 2C facing the liner 6, there may be a plurality of ridges 21 protruding from the base body 2, preferably arranged in a ring (FIG. 6).

As the said ridges or cusps melt at least partially, this facilitates the welding operation, which may be, for example, ultrasound welding.

The seal 5, which may be shaped like a flat ring, may be snap-fitted to the base body 2.

For this purpose, the base body may feature flexible sectors 31, which may be endowed with an undercut or tooth 31A, which snap-fit the seal 6, cooperating with the seat 4.

FIGS. 9 to 12 show a further variant of the invention.

In this variant, the coupling between the base body 2 and the liner 6 is achieved mechanically.

Advantageously, the liner 6 may feature, at a free end of the side wall thereof (see FIG. 11), at least one first protruding tooth 35 (continuous or discontinuous), which creates an undercut or a snap fit between the lining 6 and the base body 2.

In order to torsionally couple the base body 2 and the liner 6, at least one of the pieces may feature a finely ribbed edge 10A, 10B.

Both pieces may also each feature a finely ribbed edge 10A, 10B which are mutually engaged.

The finely ribbed edge 10A of the base body is featured on an external surface of the skirt 11, while the finely ribbed edge 10B of the liner is featured on the part of the side wall 6B facing the base body 2.

The finely ribbed edge 10B of the liner and the tooth 35 (also of the liner) are made with minimum differences in thickness (as described above), so as to minimise or eliminate the shrinkage that occurs during the moulding stage; this is to prevent the external aesthetic of the liner being undermined, which, as already mentioned, is fundamental.

The seal 5, meanwhile, may also be fastened to the base body 2 by snap-fitting.

Advantageously, therefore, there is a second tooth 36 (continuous or discontinuous) on the base body 2 which, together with the seat 4, locks the seal 5 in the final position thereof.

In this case, the seal 5 may be a disc.

It goes without saying that, in this configuration, the seal 5 can also be locked using a system similar to that already described for the previous embodiment (sectors 31 with flat annular seal).

Figure 14:
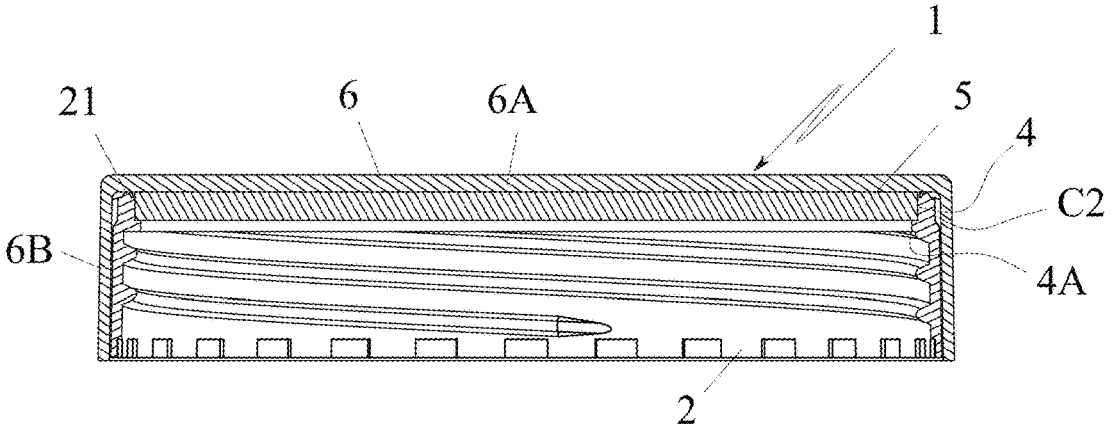
FIG. 14 is a diametrical sectional view of a further embodiment of the cap in FIG. 1.
Figure 15:
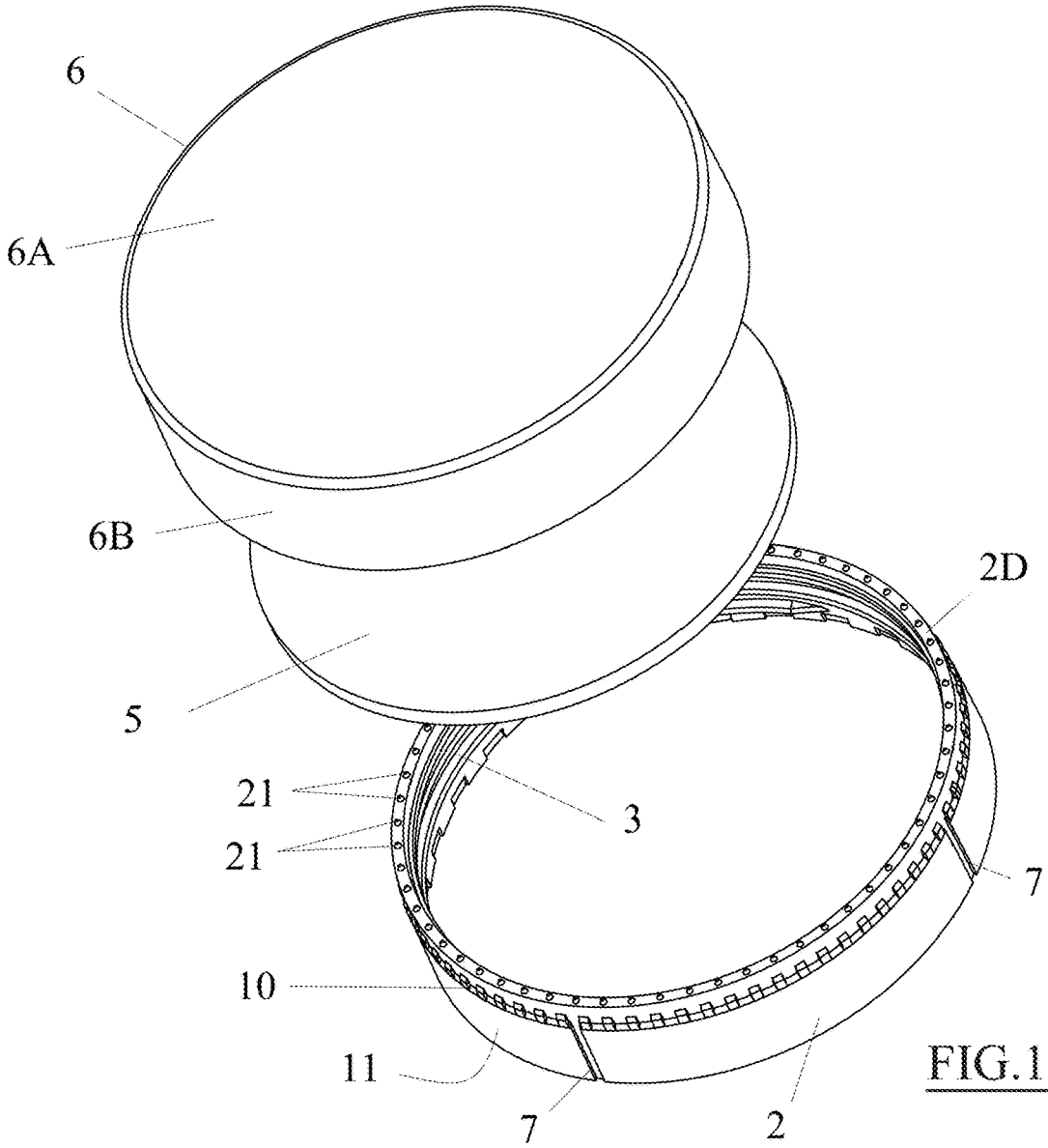
FIG. 15 is an exploded perspective view of the cap in FIG. 14.

Reference will now be made to FIGS. 14 and 15.

In this configuration, the base body 2' can have a ring configuration and the seal 5 is sandwiched between the base body 2' and the liner 6.

The seat 4 in which the said seal 5 is housed may be made at a second free end 2D of the said lateral surface 2A and may comprise an annular step 4A (FIG. 14) on which the said seal 5 rests.

Preferably, the base body 2 features the said ridges or cusps 21, which are useful for joining the two components by ultrasonic welding.

Figure 1:
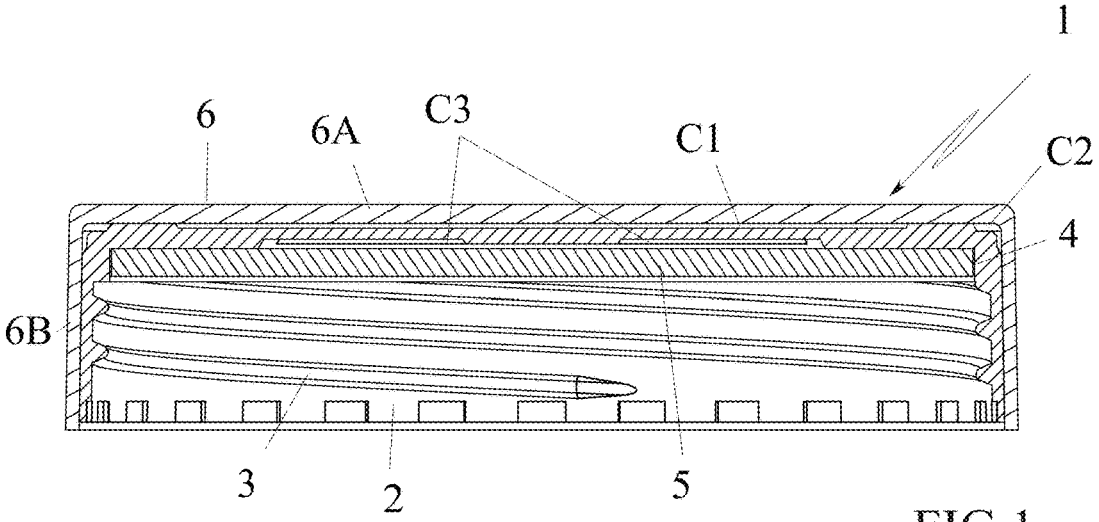
FIG. 1 is a diametrical sectional view of the cap according to the present invention.

Obviously, instead of welding, the base body 2 and the liner 6 may also be fastened using adhesive, as in the embodiment in FIG. 1. In this case, the base body will take on a slightly different conformation which is easily inferred from this description (for example without the cusps 21), with the adhesive placed only in the cavity corresponding to that denoted C2 in FIG. 1.

Figure 16:
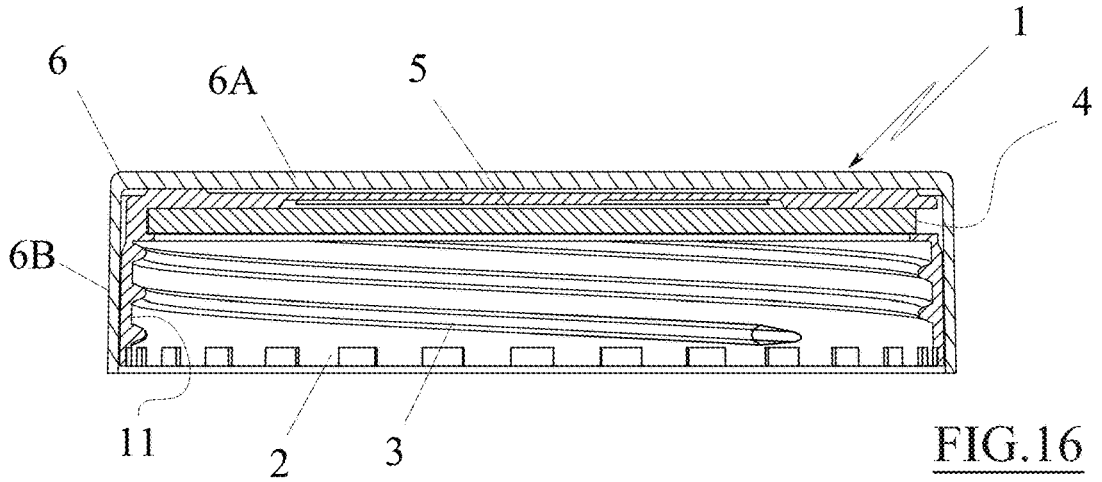
FIG. 16 is a diametrical sectional view of a further embodiment of the cap in FIG. 1.
Figure 17:
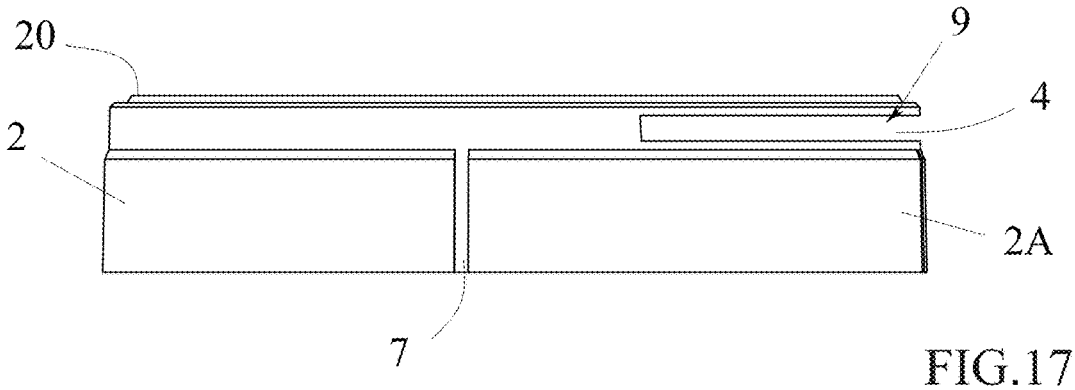
FIG. 17 is a side view of part of the cap in FIG. 16.
Figure 18:
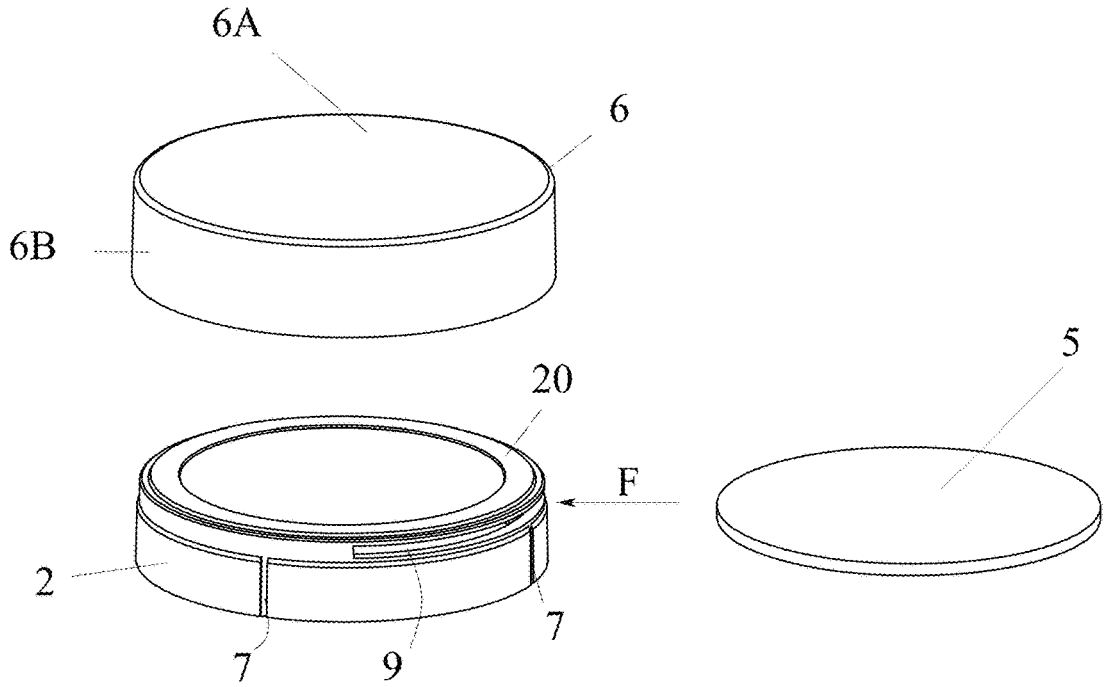
FIG. 18 is an exploded perspective view of the cap in FIG. 16.

In the configuration of FIGS. 16-18, the seat 4 of the base body 2 is configured as a pocket and provides an access 9 for the said seal 5 which opens onto the said lateral surface 2A of the base body 2.

Therefore, during assembly, first the seal 5 is inserted into the access 9 (arrow F, from the base body side) and then the liner 6 is fitted onto the base body 2.

The seal 5 is preferably disc-shaped.

The base body 2 and the liner 6 may be fastened by ultrasonic welding (and therefore the cusps 21 may be envisaged which facilitate the operation) or with adhesive.

It should be underlined that in this configuration, as in the others described, it is also possible to perform ultrasonic or laser welding (as an alternative to adhesive) even if the cusps 21 are absent, by exploiting, for example, the annular support 20.

Various embodiments of the innovation have been disclosed herein, but further embodiments may also be conceived using the same innovative concept.

The invention claimed is:

1. A cap (1) comprising a base body (2, 2') provided, on one of its inner sides, with a thread (3), a seat (4) in which a seal (5) is at least partially housed, and a liner (6) shod on the base body (2) and torsionally attached to it, wherein the liner completely conceals the base body (2) in side views and at least in a plan view;

wherein a contact surface between a celling (2C) of the base body (2) and the liner (6) is defined by an annular support (20) protruding from the base body (2) or by a plurality of ridges (21) protruding from the base body (2) and arranged in a ring pattern; and wherein the base body (2) presents, on an outer side surface thereof (2A), at least one groove (7) acting as a vent for air trapped between the base body (2) and the liner (6) during a mutual coupling thereof, the groove (7) presenting a first end opening on a free edge (2B) of the base body (2) and a second end (7B) opening on an interconnecting edge between said lateral surface (2A) and a ceiling (2C) of said base body (2).

2. The cap according to claim 1, wherein the base body (2), the seal (5) and the liner (6) are made of a single plastic material.

3. The cap according to claim 1, wherein the base body (2) is cup-shaped.

4. The cap according to claim 1, wherein said seal (5) is disc-shaped or flat-ring shaped, and is snap-engaged with said base body (2).

5. The cap according to claim 1, wherein said base body (2') has a ring configuration, and said seal (5) is sandwiched tightly between said base body (2') and said liner.

6. The cap according to claim 1, wherein the seat (4) in which said seal (5) is housed is made at a second free end (2D) of said side surface (2A) and includes an annular step (4A) on which said seal (5) rests.

7. The cap according to claim 1, wherein said seat (4) is configured as a pocket and includes an access (9) for said seal (5) opening on said lateral surface (2A) of said base body (2).

8. The cap according to claim 1, wherein the base body (2) is welded to the liner (6) at said annular support (20) or at said plurality of ridges (21).

9. The cap according to claim 1, wherein the base body (2) has, at least on a portion of said lateral surface (2A), a toothed crown (10) which aid a torsional coupling with the liner (6) by mating with a smooth surface of the liner (6) or with a corresponding toothed portion (10A) of the liner.

10. The cap according to claim 1, wherein, between the base body (2) and the liner (6) there is an adhesive or wherein between the base body and a gasket (5) there is an adhesive or wherein the base body (2) and the liner (6) are mutually welded.

* * * * *